US010473416B2

(12) United States Patent
Strombeck

(10) Patent No.: US 10,473,416 B2
(45) **Date of Patent: *Nov. 12, 2019**

(54) EXTRACTOR PIN TOOL

(71) Applicant: BECK, INC., Van Nuys, CA (US)

(72) Inventor: Michael R. Strombeck, Simi Valley, CA (US)

(73) Assignee: BECK, INC., Van Nuys, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/946,640

(22) Filed: Apr. 5, 2018

(65) Prior Publication Data

US 2018/0224236 A1 Aug. 9, 2018

Related U.S. Application Data

(63) Continuation of application No. 15/582,314, filed on Apr. 28, 2017, now Pat. No. 9,945,633.

(60) Provisional application No. 62/328,992, filed on Apr. 28, 2016.

(51) Int. Cl.

| | |
|---|---|
| ***F41A 35/00*** | (2006.01) |
| ***F41A 11/00*** | (2006.01) |
| ***F41A 15/14*** | (2006.01) |

(52) U.S. Cl.

CPC ..... *F41A 35/00* (2013.01); *F41A 11/00* (2013.01); *F41A 15/14* (2013.01)

(58) Field of Classification Search

CPC ..... F41A 25/00; F41A 29/02; F41G 1/545; F41G 1/54

USPC ..... 42/108, 90, 106

See application file for complete search history.

(56) References Cited

U.S. PATENT DOCUMENTS

| | | | | |
|---|---|---|---|---|
| 7,637,049 | B1 | 12/2009 | Samson | |
| 7,644,529 | B2 * | 1/2010 | Hopper | F41A 29/02 15/93.1 |
| 8,069,606 | B1 | 12/2011 | Saur | |
| 8,091,266 | B2 | 1/2012 | Huang | |
| 8,458,948 | B2 | 6/2013 | Worrall et al. | |
| 8,850,738 | B2 | 10/2014 | Silver | |
| 9,127,899 | B2 * | 9/2015 | Shipman | F41C 27/00 |
| 9,151,563 | B2 * | 10/2015 | Davis | F41A 29/02 |
| 9,279,634 | B2 | 3/2016 | Shipman et al. | |
| 9,784,535 | B1 | 10/2017 | Chen | |
| 2009/0178324 | A1 | 7/2009 | Hopper | |
| 2009/0199345 | A1 | 8/2009 | Morgan | |
| 2010/0186769 | A1 * | 7/2010 | Jaquish | B08B 1/00 134/6 |
| 2011/0113669 | A1 * | 5/2011 | Oselinsky | F41A 29/02 42/90 |

(Continued)

*Primary Examiner* — Joshua E Freeman

(74) *Attorney, Agent, or Firm* — Fish IP Law, LLP

(57) ABSTRACT

Apparatus, systems, and methods for the maintenance, repair, modification, cleaning, disassembly, and reassembly of firearms and firearm components are disclosed. Particular embodiments include tools to aid in the removal and insertion of an extractor pin from the bolt assembly of an AR-15 or M-16 rifle. Preferred embodiments are directed to bolt assemblies for .223 and .308 imperial caliber firearms, as well as 5.56 and 7.62 metric caliber firearms. The tools include a housing with a channel to receive the bolt, a channel to insert a locking rod to orient and secure the bolt in the housing, a channel for inserting a removal rod to remove the extractor pin from the bolt or an inserting rod to insert the extractor pin into the bolt.

12 Claims, 16 Drawing Sheets

(56) References Cited

U.S. PATENT DOCUMENTS

| | | | | |
|---|---|---|---|---|
| 2011/0252688 | A1 | 10/2011 | Bietsch | |
| 2013/0047483 | A1* | 2/2013 | Horne | F41C 27/00 42/90 |
| 2013/0133239 | A1 | 5/2013 | Bowman | |
| 2013/0192118 | A1 | 8/2013 | Shipman | |
| 2013/0255128 | A1* | 10/2013 | Fisher | F41C 27/00 42/108 |
| 2015/0027026 | A1* | 1/2015 | Bowman | F41G 1/00 42/115 |
| 2017/0314882 | A1 | 11/2017 | Strombeck | |

* cited by examiner

EXTRACTOR PIN TOOL

This application is a continuation of U.S. patent application with the Ser. No. 15/582,314, filed Apr. 28, 2017, which claims priority to U.S. provisional application with the Ser. No. 62/328,992, filed Apr. 28, 2016, both of which are incorporated herein by reference in their entirety.

FIELD OF THE INVENTION

The field of the invention is a tool to aid in firearm maintenance.

BACKGROUND

Most machines and devices that involve moving parts and precision require regular maintenance and cleaning. Firearms are no exception. As hobbyists, weekend warriors, and professional users of firearms are aware, a failure to properly clean a firearm and its components can result in poor performance or a complete failure of the firearm. Thus, there is a need in the art for systems, methods, and devices to aid in firearm maintenance, modification, cleaning, and repair.

Various complex devices are known in the art for maintaining firearms, such as the automated maintenance methods and devices disclosed in U.S. Pat. No. 8,458,948 to Worrall et al. However, such devices are too complex and expensive for the average user to operate. Further, such devices and methods are poorly suited for impromptu and emergency repairs in the field or on the range. Thus, there is a need for simple, portable, and efficient systems, methods, and devices that can be used for firearm maintenance in the field.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Simple, single purpose maintenance tools are also known in the art, such as the multi-tool for firearm maintenance and safety disclosed in U.S. Pat. No. 8,850,738 to Silver. While such single or limited purpose tools may be effective for general uses, they do not solve maintenance, repair, cleaning, and disassembly problems that are unique to specific components or parts of a firearm. For example, the tool of '738 Silver is wholly ineffective at cleaning, maintaining, repairing, or disassembling the bolt assembly of an AR-15 or M-16 model rifle, or similar bolt assemblies.

Some efforts have been made to create tools for the maintenance of AR-15 bolt assemblies, such as those disclosed in U.S. Pat. No. 9,279,634 to Shipman et al. However, such tools as disclosed by '634 Shipman are limited to cleaning the exterior surface of AR-15 bolt assemblies, and are not suited for the disassembly of bolt assemblies or the maintenance and cleaning of bolt assembly components. In particular, some methods and systems are known in the art to aid with the removal of the extractor pin of an AR-15 bolt assembly by use of a vice and boards to secure the bolt, and a hammer and punch to remove the extractor pin, as seen at URL youtube.com/watch?v=gSw4PejKkMU. However such methods and systems are clumsy, not portable, and poorly suited for field maintenance.

Thus, there remains a need for systems, methods, and devices for aiding in the maintenance of firearms.

SUMMARY OF THE INVENTION

The inventive subject matter provides apparatus, systems, and methods for the maintenance, repair, modification, cleaning, disassembly, and reassembly of firearms and firearm components. Particular embodiments include tools to aid in the removal and insertion of an extractor pin from the bolt assembly of an AR-15 or M-16 rifle, or similar bolts. While the inventive subject matter contemplates tools and methods adapted for bolt assemblies for various caliber firearms, preferred embodiments are directed to bolt assemblies for .223 and .308 imperial caliber firearms, as well as 5.56 and 7.62 metric caliber firearms.

In some embodiments, the inventive subject matter contemplates an apparatus for working with a firearm, where the firearm comprises a bolt having an extractor pin, a first hole for receiving the extractor pin, and a second hole. The apparatus includes a locking rod, a removing rod, and a housing having a receiving channel, a locking channel, and an applicator channel.

In preferred embodiments the receiving channel has a size and dimension such that it can receive a portion of the bolt of the firearm. The locking channel has a size and dimension that corresponds with the locking rod, such that the locking rod can pass through at least a portion of the locking channel. In some embodiments, the locking rod has a size and dimension such that, when the firearm bolt is inserted into the receiving channel, at least a portion of the locking rod passes through the locking channel and is received by a portion of the second hole of the bolt.

The applicator channel has a size and dimension that corresponds with the removal rod, such that the removal rod can pass through at least a portion of the applicator channel. In some embodiments, the removal rod has a size and a dimension that corresponds to both the applicator channel and the first hole of the bolt such that, when the bolt is inserted into the receiving channel, a portion of the removal rod can pass through the applicator channel and a portion of the first hole of the bolt.

It is contemplated that the receiving channel of some embodiments further comprises a groove. The grove can have a size and a dimension configured to engage with a portion of the bolt such that, when the bolt is fully inserted in the receiving channel, the first hole of the bolt aligns with the applicator channel.

In some embodiments the second hole of the bolt has a first and a second opening, a portion of the locking rod has size and dimension corresponding to the first and second opening such that the portion of the locking rod can pass through the first opening, but not the second opening. Viewed from another perspective, the dimension of the second hole of the bolt relate to the dimensions of the locking rod such that the locking rod can penetrate the second hole by a first opening, but cannot penetrate the second hole by a second opening. In some embodiments, the locking rod engages with the second hole of the bolt when the bolt is in one particular orientation with respect to the housing. In some embodiments, a first portion of the locking rod has a dimension narrower than a second portion of the locking rod such that the first portion fits into an opening of the second hole on the bolt.

In some embodiments the receiving channel has a first end opposite to a second end, wherein the first end is configured to receive the bolt of the firearm. It is contemplated that a portion of the receiving channel tapers from the first toward the second end.

In some embodiments a portion of the removal rod is sized and dimensioned to pass through the first hole of the bolt. The removal rod can have a first end comprising a first shoulder and a removal stem extending away from the first shoulder. The length from the first shoulder to the end of the removal stem is at least a sum of the length of the applicator channel and a length of the first hole of the bolt. In some embodiments the removal rod can have a second end comprising a second shoulder and an inserting stem extending away from the second shoulder. The length from the second shoulder to the end of the inserting stem is at least the length of the applicator channel. In other embodiments, the inserting rod can be separate and distinct from the removal rod.

In some embodiments the housing further comprises a cavity with an opening defined by a rim on a surface of the housing. The cavity can be sized and dimensioned to receive the locking rod and the removal rod. In some embodiments, the rim is coupled to a lid. It is also contemplated that the housing can comprise a plurality of recesses such that the locking rod and the removal rod can releasably engage with a recess.

In some embodiments, the channels of the housing have specific orientations. For instance, the receiving channel can be aligned such that its longitudinal axis is perpendicular to the longitudinal axis of the locking channel. In some embodiments, the applicator channel intersects a portion of the receiving channel. The housing can further comprise a removal channel that is aligned along the longitudinal axis of the applicator channel. Such removal channel can have a size and a dimension corresponding with the size and dimension of the extractor pin. In some embodiments, the removal channel is configured to receive the extractor pin.

The inventive subject matter also contemplates a method for maintaining a firearm having a bolt that comprises an extractor pin, a first hole, and a second hole, wherein the first hole receives the extractor pin. It is contemplated the method employs an apparatus comprising a housing having a receiving channel, a locking channel, an applicator channel, a locking rod and a removal rod. In some embodiments, the method comprises inserting the bolt into the receiving channel of the housing, locking the bolt in an orientation by inserting the locking rod into the locking channel, and removing the extractor pin from the bolt by pressing the removal rod into the applicator channel. These steps can be performed in the order as stated or any variation. Some embodiments comprise a further step wherein the extractor pin can be placed in the applicator channel and inserted into the first hole of the bolt by an inserting rod.

In other embodiments the inventive subject matter contemplates a tool for maintaining a firearm comprising an orientation arm sized and dimensioned to couple with a firearm component, a first clasping arm pivotally coupled to a second clasping arm, wherein the first and second clasping arms have an open conformation and a closed conformation, a channel disposed through the first clasping arm and aligned along the axis of a sub-component of the firearm component, and an extracting pin sized and dimensioned to enter the channel and couple with the firearm component. In some embodiments the extracting pin displaces the sub-component of the firearm when it couples with the firearm component.

Descriptions throughout this document include information that may be useful in understanding the present invention. It is not an admission that any of the information provided herein is prior art or relevant to the presently claimed invention, or that any publication specifically or implicitly referenced is prior art.

In some embodiments, the numbers expressing quantities of ingredients, properties such as concentration, reaction conditions, sizes, dimensions, lengths, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

Various objects, features, aspects and advantages of the inventive subject matter will become more apparent from the following detailed description of preferred embodiments, along with the accompanying drawing figures in which like numerals represent like components.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

DETAILED DESCRIPTION

The inventive subject matter provides apparatus, systems, and methods to aid in the disassembly, maintenance, and cleaning of firearm components, preferably related to the extractor and extractor pin of AR-15 and M-16 rifle bolt assemblies. Tools of the inventive subject matter are sized and dimensioned to fit firearm bolt assemblies of various calibers, and are preferably particularly sized and dimensioned for use with .223 or .308 imperial caliber firearms, or 5.56 metric caliber firearms.

It should be appreciated that firearms are typically made of rugged, resilient material, capable of withstanding a variety of environmental and physical stresses and maintaining operational capability. It is contemplated that tools and apparatus of the inventive subject matter are composed of similar or the same materials as firearm components, including for example steel, aluminum, titanium, iron, nickel, various metallic alloys, and other resilient materials. Tools composed of such materials advantageously have resilient properties similar to the firearm components, including favorably tolerating environmental and physical wear and tear associated with field use.

However, it should also be appreciated that contemplated tools may be made of lighter, cheaper materials that are less resilient than metals and alloys but none the less provide favorable characteristics. For example, tools and apparatus composed of hard and soft plastics, hard and soft rubbers, and other polymers, as well as ceramics or other crystalline materials may be lighter and to carry and provide simpler manufacturing processes. Preferred embodiments include tools and tool components comprised at least partial of polymer material, including at least 50%, 60%, or 70% of tools and tool components (by mass, weight, or volume) comprising at least one polymer material, while especially preferred embodiments comprise at least 80%, 90%, 95%, or 98% of tools and tool components (by mass, weight, or volume) comprise at least one polymer material.

Tools of the inventive subject matter can further be comprised partially, mostly, or entirely of a polymer material, but more preferably are composed of various polymer materials, including different tool components comprised of different compositions of polymer materials. For example, it is contemplated that tool components that are subject to low stress (e.g., forces less than 10N, 5N, 3N, 2N, or 1N) during use can be composed of weaker, cheaper polymer or polymer blends, while tool components that are subject to moderate or high stresses (e.g. greater than 10N, 15N, 20N, or 25N) can be composed of stronger polymer or polymer blends, and can further include additional metallic bracing. For example, a push rod subject to high stress can be composed of steel, while the push rod is fitted with a polymer handle for user comfort and ease of use.

Figure 1:
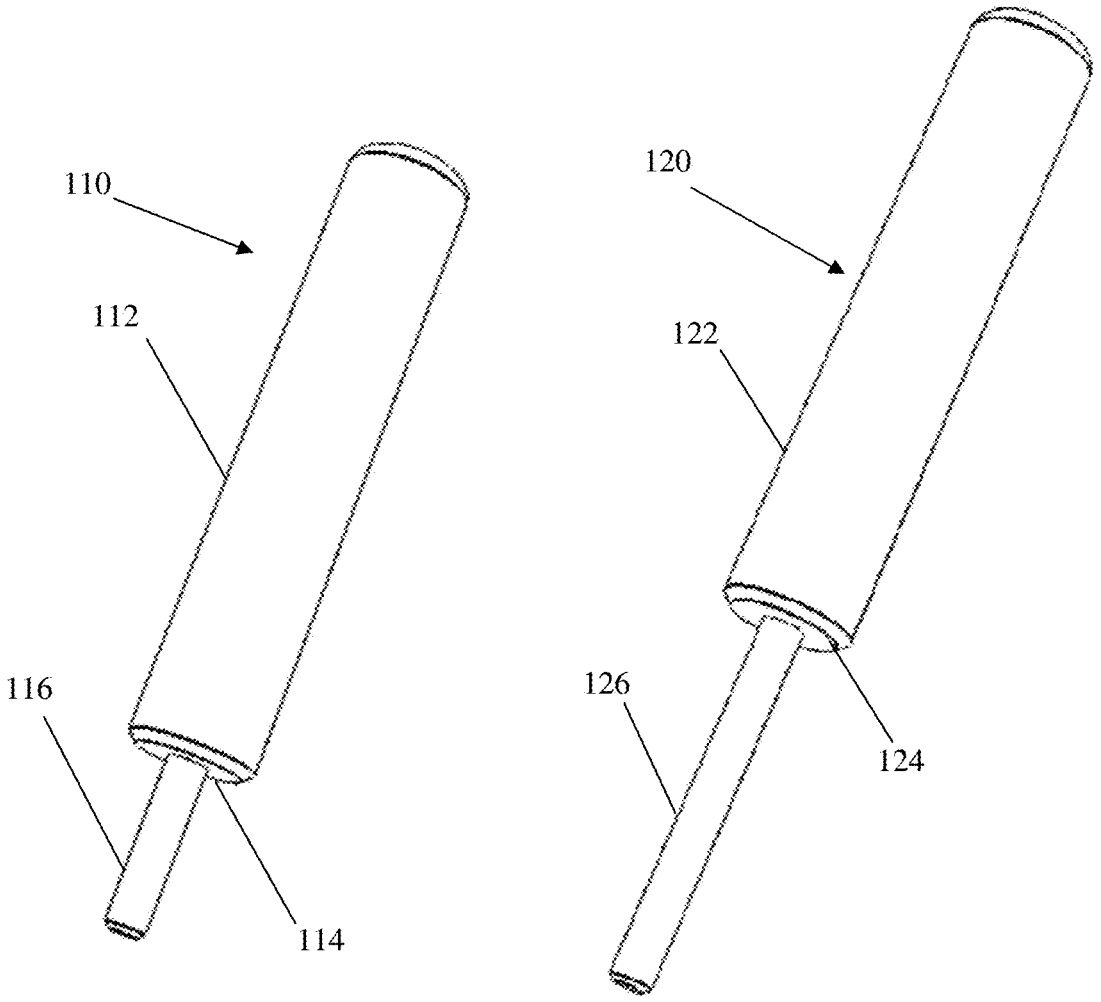
FIG. 1 is a plan view of an inserting rod and a removal rod.

FIG. 1 depicts inserting rod 110 and removal rod 120. Inserting rod 110 comprises handle 112, inserting shoulder 114, and inserting stem 116. Inserting shoulder 114 defines a change in dimension between handle 112 and inserting stem 116.

As depicted, both handle 112 and inserting stem 116 have cylindrical structures sharing the same longitudinal axis but having different radius and circumference, to wit handle 112 has a larger radius and circumference than inserting stem 116. Further, the circumference and radius of inserting stem 116 is not more than the circumference and radius of applicator channel 420 of tool block 400 in FIG. 4, such that inserting stem 116 can be inserted into applicator channel 420. It is contemplated that the circumference and radius of applicator channel 420 and inserting stem 116 will be the same, or at least within a tolerance of 0.001%, 0.01%, 0.1%, 0.5%, 0.8%, 1%, 2%, or 5% of each other. Inserting shoulder 114 is sized and dimensioned such that, as inserting rod 110 is inserted into applicator channel 420, inserting shoulder 114 comes to rest against the portion of housing 410 adjacent to applicator channel 420 and prevents further insertion of inserting rod 110 into applicator channel 420. Inserting stem 116 has a length defined as the dimension along inserting stem 116 between inserting shoulder 114 and the end of inserting stem 116. In preferred embodiments, the length of inserting stem 116 is at least the length from the opening of applicator channel 420 on the exterior of housing 410 to an intersection between applicator channel 420 and receiving channel 480.

Removal rod 120 comprises handle 122, removal shoulder 124, and removal stem 126. The relation between the size, shape, and dimensions of removal handle 122, removal shoulder 124, and removal stem 126 are similar to that of handle 112, inserting shoulder 114, and inserting stem 116. The circumference and radius of removal stem 126 is not more than the circumference and radius of applicator channel 420. It is contemplated that the circumference and radius of applicator channel 420 and removal stem 126 will be the same, or at least within a tolerance of 0.001%, 0.01%, 0.1%, 0.5%, 0.8%, 1%, 2%, or 5% of each other. Removal stem 126 can be inserted into applicator channel 420. Further, the circumference and radius of removal stem 126 is not more than the circumference and radius of extractor pin hole 224 of bolt 220 in FIG. 2. It is contemplated that the circumference and radius of extractor pin hole 224 and removal stem 126 will be the same, or at least within a tolerance of 0.001%, 0.01%, 0.1%, 0.5%, 0.8%, 1%, 2%, or 5% or each other. Removal stem 126 can be inserted into extractor pin hole 224. Viewed from another perspective, the circumference and radius of removal stem 126 is not more than the circumference and radius of extractor pin 222 of bolt 220 in FIG. 2. Removal stem 126 has a length defined as the dimension along removal stem 126 between removal shoulder 124 and the end of removal stem 126. In preferred embodiments, the length of removal stem 126 is at least the combined length of applicator channel 420 and extractor pin hole 224 of bolt 220 in FIG. 2. Viewed from another perspective, the length of removal stem 126 is equal to at least the sum of the length of applicator channel 420 and the length of extractor pin 222 of bolt 220 in FIG. 2.

It is contemplated that handles 112 and 122, as well as inserting stem 116 and removal stem 126, are composed of the same material (e.g., hard plastic, polymer, polymer blend, composite material, metallic or alloy, natural or processed woods, etc.). In preferred embodiments, handles 112 and 122 are composed of polymer or polymer blends suitable for efficient plastic manufacturing processes (e.g., blow molding, casting, compression molding, extrusion, fabrication, foaming, injection molding, rotational molding, etc.). In such embodiments, stems 116 and 126 can be comprised of the same polymer or polymer blends as handles 112 and 122, allowing for efficient manufacturing of the inserting rod 110 and removal rod 120. In especially preferred embodiments, stems 116 and 126 are composed of metal or a metal alloy (preferably steel), while handles 112 and 122 are composed of plastic.

Figure 2:
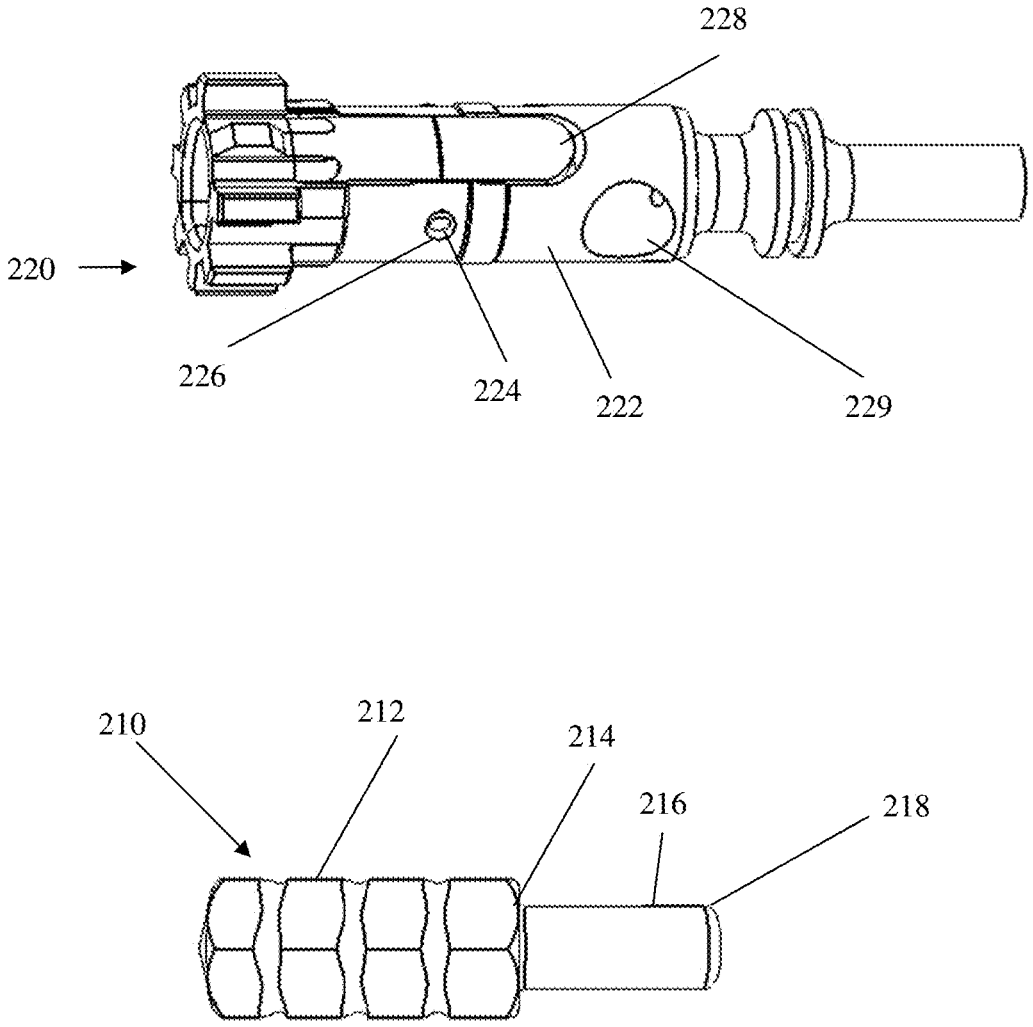
FIG. 2 is a side perspective view of a locking rod and a bolt.

FIG. 2 depicts locking rod 210 and bolt 220. Locking rod 210 comprises handle 212, locking shoulder 214, locking stem 216, and tapered portion 218. Locking stem 216 has a cylindrical structure sharing the same longitudinal axis as handle 212. Handle 212 has larger cross sectional dimensions than locking stem 216. The circumference and radius of locking stem 216 is not more than the circumference and radius of locking channel 430 of tool block 400 in FIG. 4, such that locking stem 216 can be inserted into locking channel 420. It is contemplated that the circumference and radius of locking channel 430 and locking stem 216 will be the same, or at least within a tolerance of 0.001%, 0.01%, 0.1%, 0.5%, 0.8%, 1%, 2%, or 5% of each other. Locking shoulder 214 is sized and dimensioned such that, as locking rod 210 is inserted into locking channel 430, locking shoulder 214 comes to rest against the portion of housing 410 adjacent to locking channel 430 and prevents further insertion of locking rod 210 into locking channel 420. Locking stem 216 has a length defined as the dimension along locking stem 216 between locking shoulder 214 and the end of locking stem 216. In some embodiments, the length of locking stem 216 is at least the length from the opening of locking channel 430 on the exterior of housing 410 to an intersection between locking channel 430 and receiving channel 480. In preferred embodiments, the length of locking stem 216 is not more than the combined length of locking channel 430 and tapered hole 228 of bolt 220.

As previously described, locking rod 210 can be composed of materials selected for simple manufacturing processes or low cost (e.g., plastics, polymers, polymer blend, composite material, natural or processed woods, etc.) or can be selected for high resilience or life of use (e.g., high density plastics, metals, metal alloys, etc). In preferred embodiments, locking rod 210 is composed of polymers or polymer blends and can be hollow to reduce cost of material for manufacture.

Bolt 220 comprises bolt body 222, extractor pin 224, extractor pin hole 226, extractor 228, and tapered hole 229. Extractor 228 is coupled to bolt body 222 by extractor pin 224. The removal of extractor pin 224 from extractor pin hole 226 decouples extractor 228 from bolt body 222. Such decoupling permits extractor 228 to be removed from bolt 220, enabling the cleaning, maintenance, repair, and modification of extractor 228 and the portions of the bolt body that interface with extractor 228. Tapered hole 229 configured as a through hole. The opening of tapered hole 229 depicted in FIG. 2 has a larger dimension then the opening of tapered hole 229 on the reverse side of bolt 220, not depicted.

While bolt 220 is representative of a bolt for an AR-15 or M-16 rifle, it should be appreciated that such rifles are available in various calibers (imperial or metric) having bolts of different sizes and dimensions. It is contemplated that various tools and methods of the inventive subject matter are sized and dimensioned for use with bolts for various caliber rifles (e.g., .17, .22, .223, and .30 imperial caliber, or 5.56, 6.5, 7.62 metric caliber), and preferably sized and dimensioned for use with .223 or .308 imperial caliber or 5.56 or 7.62 metric caliber. It is also contemplated that tools sized and dimensioned for use with larger caliber bolts (e.g. .308 imperial caliber or 7.62 metric caliber) may be fitted with adapters (e.g., tube, hollow cylinder, spacers, etc) such that the larger caliber tool can be used properly with smaller caliber bolts. Viewed from another perspective, it is contemplated that tools suited for .308 imperial caliber bolts can be fitted with adapters so that the tool can be used with .223 imperial caliber bolts.

Figure 3:
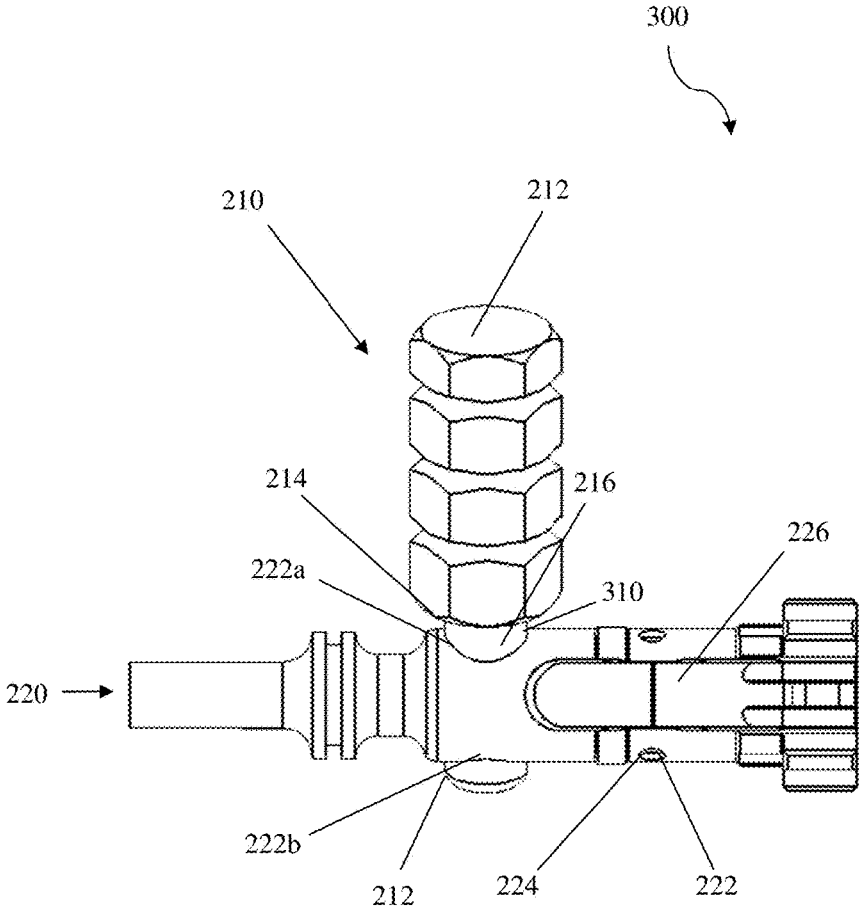
FIG. 3 is a side perspective view of a lock and bolt assembly.

FIG. 3 depicts lock and bolt assembly 300, comprising locking rod 210 and bolt 220 joined at intersection 310. As discussed above, bolt 220 comprises tapered hole 222, which further comprises tapered hole openings **222*a* and 222*b* as depicted in FIG. 3. Tapered hole opening 222*a* has a circumferential dimension that is larger than tapered hole opening 222*b*. Further, locking stem 216 and tapered portion 212 are sized and dimensioned to correspond with the dimensions of tapered hole openings 222*a* and 222*b* such that tapered portion 212 can be inserted into and through tapered hole opening 222*a*, but cannot be inserted into and through tapered hole opening 222*b*. Viewed from another perspective, tapered hole 222, tapered hole openings 222*a* and 222*b*, locking stem 216, and tapered portion 212 are sized and dimensioned such that locking rod 210 can only be inserted into bolt 220 through tapered hole opening 222*a***.

Further, a length along locking stem 216 is defined between locking shoulder 214 and intersection 310. This length is roughly (e.g. within 5%, within 10%, or within 20%) the length of locking channel 430.

Figure 9A:
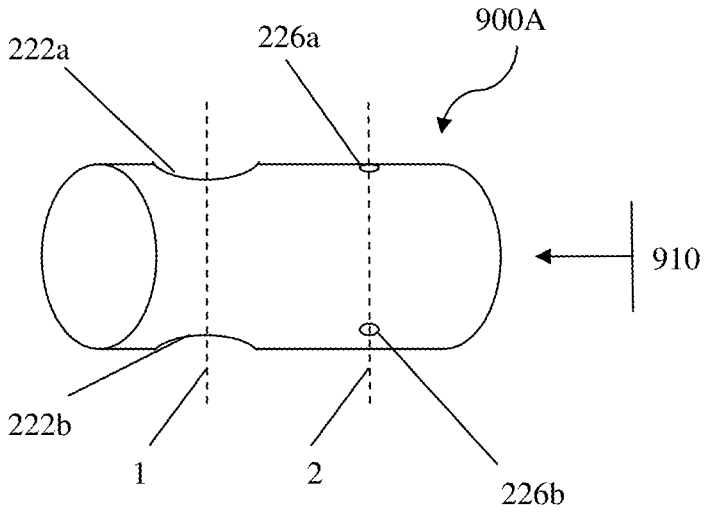
FIG. 9*a* is a side perspective view of a section of a bolt.
Figure 9B:
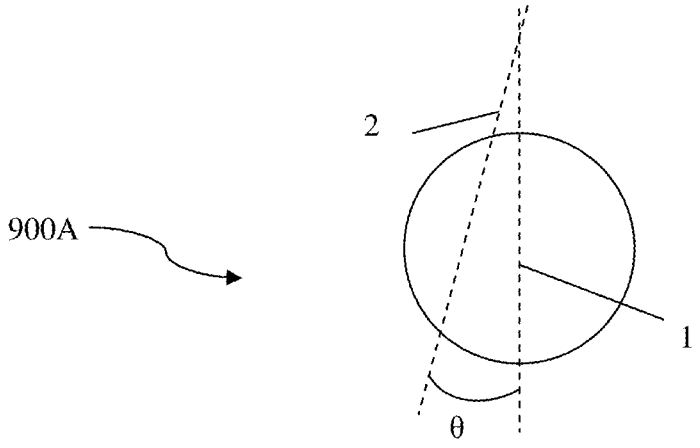
FIG. 9*b* is a longitudinal perspective view of a section of a bolt.

FIGS. 9A and 9B depict bolt section 900A viewed from a side perspective and along sight line 910, respectively. Tapered hole openings 222*a* and 222*b* have the dimensions as described above. Further illustrated is axis 1, which corresponds with a longitudinal axis of tapered hole 222. Also illustrated is axis 2, which corresponds with a longitudinal axis of extractor pin hole 226 having extractor pin hole openings 226*a* and 226*b*. As seen in the longitudinal perspective view in FIG. 9*b*, the projection of axis 2 on axis 1 forms angle θ. It is generally expected that angle θ will be greater than 10°, 15°, 20°, 25°, or 30°, and in preferred embodiments will be 22.5°.

Figure 4:
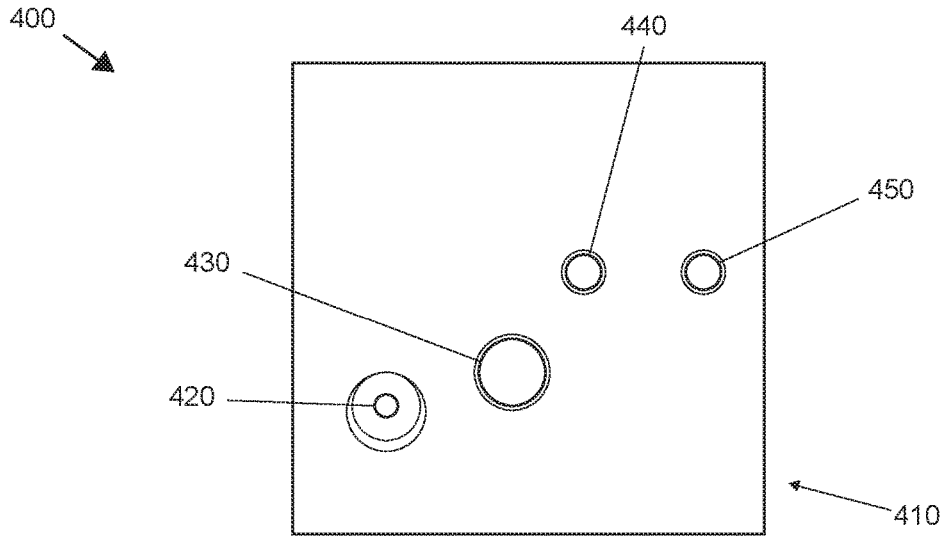
FIG. 4 is a top plan view of a tool block.

FIG. 4 depicts top plan view of tool block 400 comprising housing 410, applicator channel 420, locking channel 430, inserting rod cavity 440, and removal rod cavity 450. Inserting rod cavity 440 and removal rod cavity 450 are sized and dimensioned to receive and releasably secure inserting rod 110 and removing rod 120, respectively. Applicator channel 420 and locking channel 430 are oriented such that each channel intersects receiving channel 480 (see FIG. 5). Further, a projection along the longitudinal axis of receiving channel 480 of the longitudinal axis of applicator channel 420 and locking channel 430 produces an angle of θ from FIG. 9B between the axes. Viewed from another perspective, a projection of the applicator channel 420 axis and the locking channel 430 axis forms the angle θ from FIG. 9B between the two axes.

It is contemplated that tool block 400 can be made of various materials already described. In embodiments well suited for field use, tools of the inventive subject matter can be made of high resilience plastics that are light weight. For tools suited for use in homes, workshops, or gunsmithing, the tools can be made of higher quality materials, such as machined aluminum, and have similar finish and feel as the material the firearm is composed of.

Figure 5:
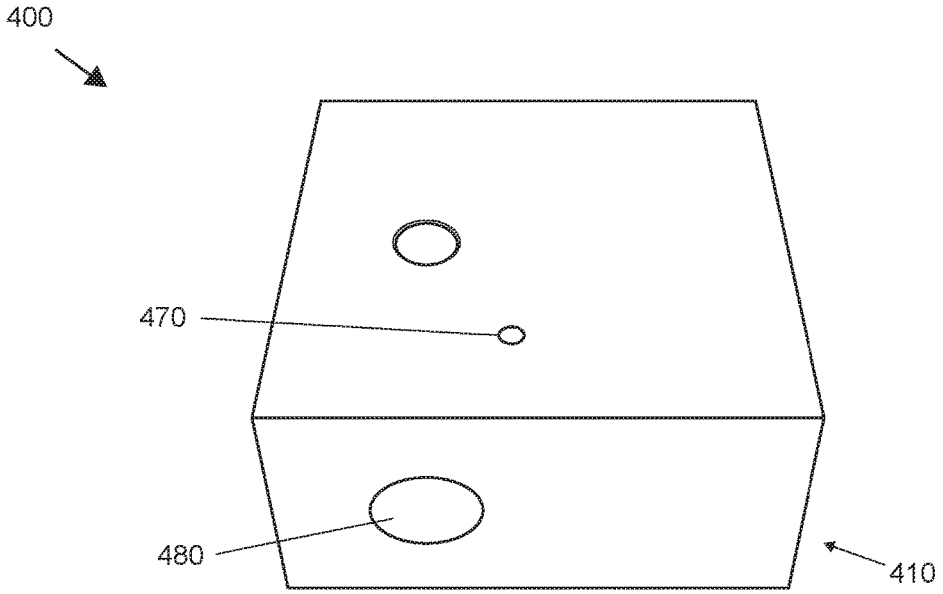
FIG. 5 is a bottom, back side perspective view of a tool block.

FIG. 5 depicts a bottom, back side perspective view of tool block 400 comprising housing 410 and further comprising receiving channel 480 and removal channel 470. Removal channel 470 is oriented such that is aligns and shares a longitudinal axis with applicator channel 420 (not pictured). Further, removal channel 470 intersects receiving channel 480. In some embodiments, the circumference and radius of removal channel 470 is at least the circumference and radius of applicator channel 420. Viewed from another perspective, the circumference and radius of removal channel 470 is at least the circumference and radius of extractor pin 222 and extractor pin hole 224.

Figure 6:
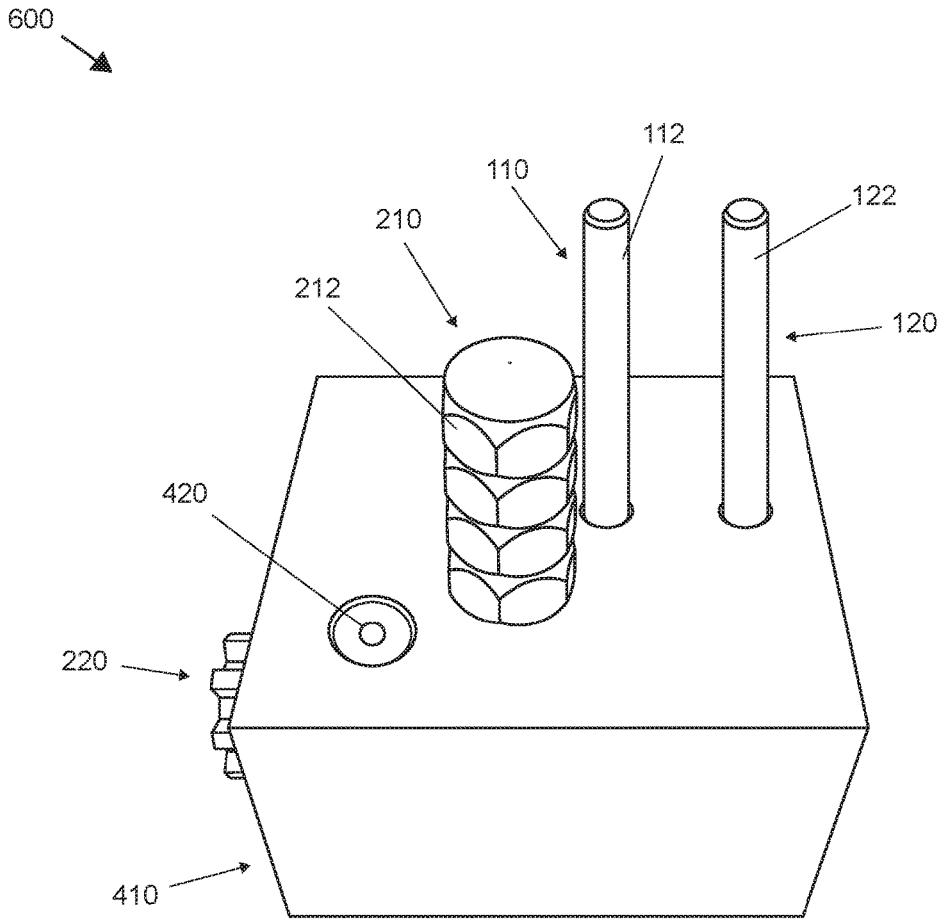
FIG. 6 is a top, right side perspective view of a tool assembly.

FIG. 6 depicts a top, right side perspective view of tool assembly 600 comprising housing 410, locking rod 210, removal rod 120, inserting rod 110, and applicator channel 420. FIG. 1 also shows bolt 220 which is inserted into housing 410. Some components of tool assembly 600 cannot be seen in FIG. 6 but are depicted in other figures, such as inserting rod cavity 440, removal rod cavity 450, locking channel 430, receiving channel 480, and removal channel 470 of tool block 400 in FIGS. 4 and 5. As depicted, locking rod 210 and bolt 220 are engaged as shown by lock and bolt assembly 300 in FIG. 3. As such, the longitudinal axis of locking rod 210 and the longitudinal axis of bolt 220 are perpendicular. Viewed from another perspective, the longitudinal axis of receiving channel 480 and the longitudinal axis of locking channel 430 are perpendicular.

Figure 7:
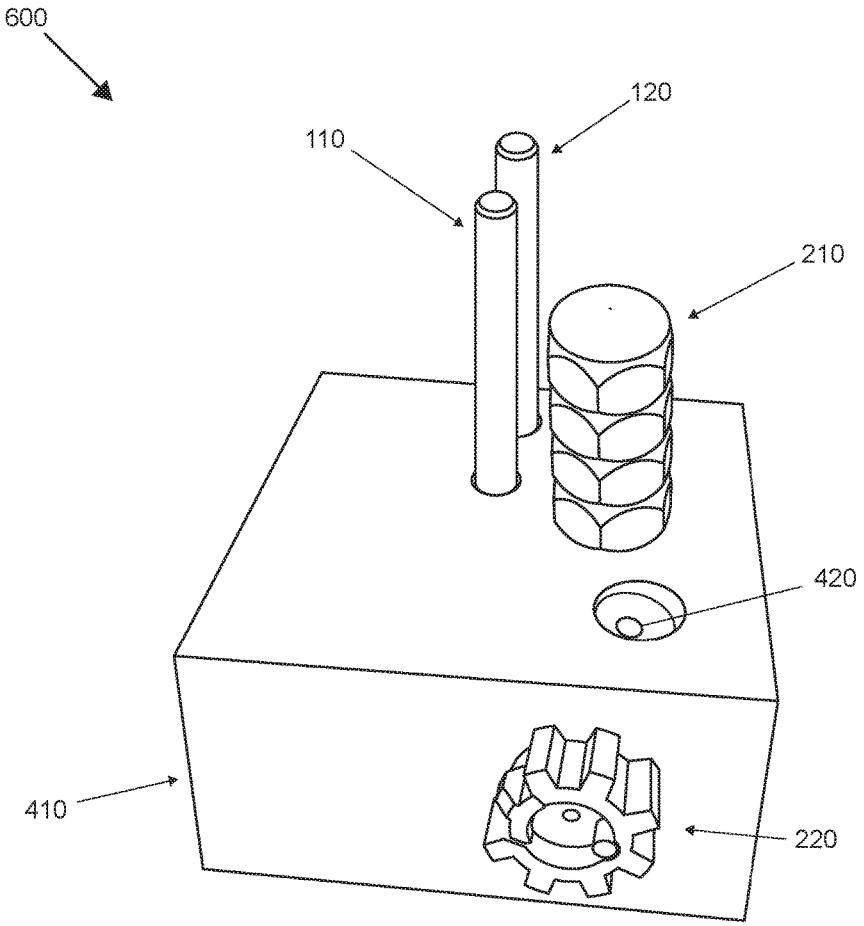
FIG. 7 is a top, right, front side perspective view of a tool assembly.
Figure 8:
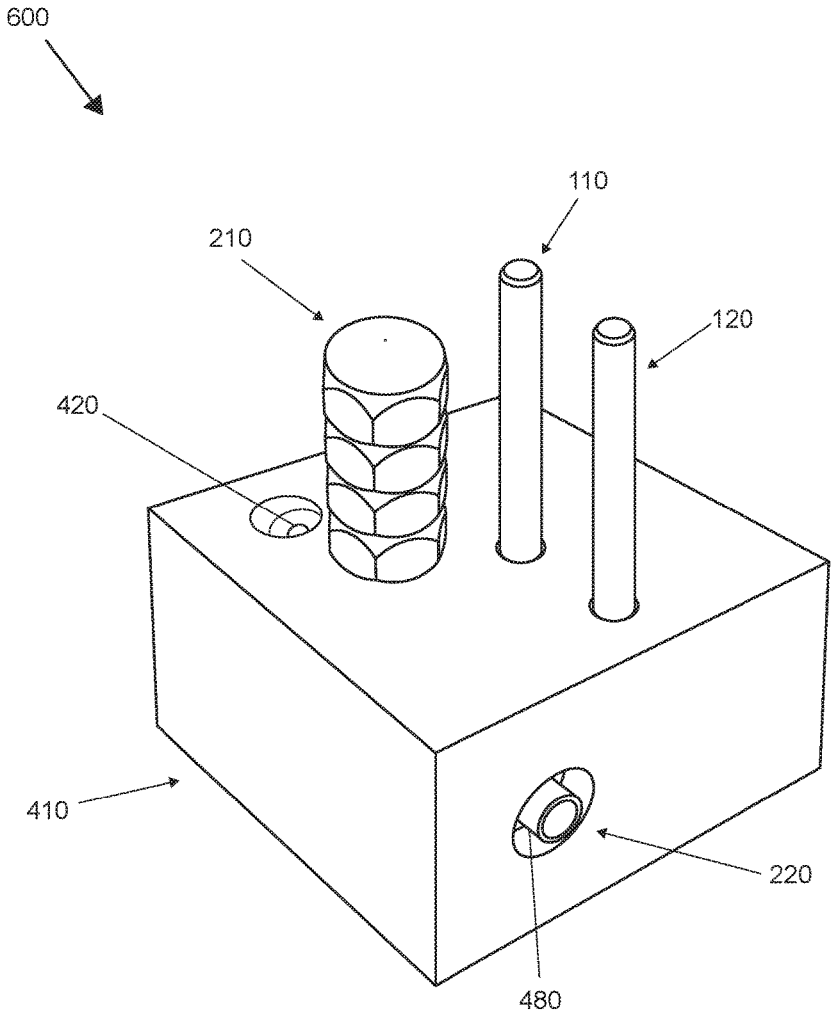
FIG. 8 is a top, right, back side perspective view of a tool assembly.

FIGS. 7 and 8 depict additional views of tool assembly 600 from FIG. 6. Similar numbered features have the same size, dimension, and orientation as discussed above.

Figure 10:
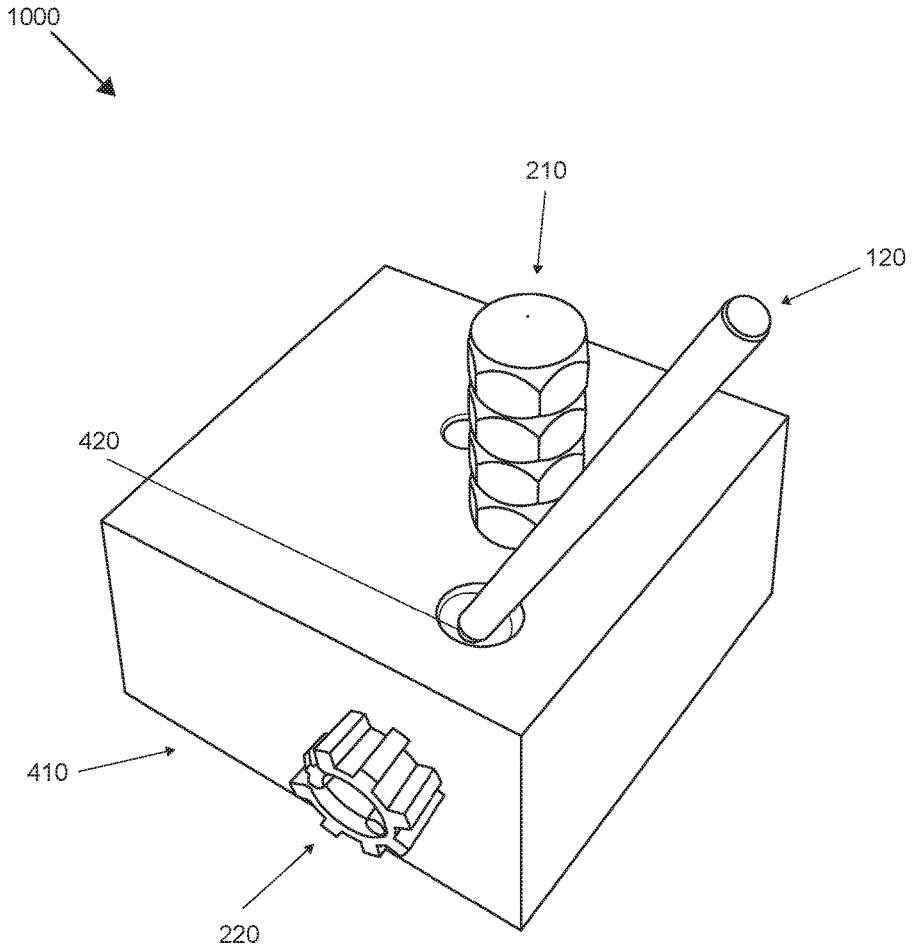
FIG. 10 is a top, right, front side perspective view of a tool assembly.

FIG. 10 depicts the same housing 410 and some components of tool assembly 600 as in FIGS. 6-8, albeit in tool assembly configuration 1000. As depicted, tool assembly configuration 1000 comprises bolt 220, locking rod 210, removal rod 120, and housing 410 having applicator channel 420. In tool assembly configuration 1000, bolt 220 is locked in position within housing 410 by locking rod 210, having the configuration of lock and bolt assembly 300 in FIG. 3. While in this position, extractor pin hole 226 is in alignment with applicator channel 420. In tool assembly configuration 1000, removal rod 120 has been pressed into applicator channel 420 until removal shoulder 124 abuts the portion of housing 410 adjacent to the opening to applicator channel 420. In this configuration, a portion of stem 126 has passed through applicator channel 420 and into extractor pin hole 226, thereby displacing extractor pin 224. When extractor pin 224 is displaced by removing stem 126, extractor pin 224 passes into removal channel 470 for collection.

FIG. 10 can is also representative of the configuration of tool assembly 600 for inserting extractor pin 224 into extractor pin hole 226. In such tool assembly configurations, bolt 220 is locked in place in housing 410 by locking rod 210 and oriented as depicted in FIG. 10. Extractor pin 224 is then placed into applicator channel 420. Extractor pin 224 is then inserted into and seated in extractor pin hole 226, thereby coupling extractor 228 to bolt body 222. This is accomplished by driving extractor pin 224 into place by pressing inserting rod into applicator channel 420. Inserting stem 116 presses extracting pin 224 into extracting pin hole 226, until inserting stem is prevented from further insertion by inserting shoulder 114 abutting a portion of housing 410 adjacent to applicator channel 420. Viewed from another perspective, when inserting shoulder 114 abuts a portion of housing 410 adjacent applicator channel 420, inserting stem 116 has seated extracting pin 224 into place within extracting pin hole 226.

Figure 11:
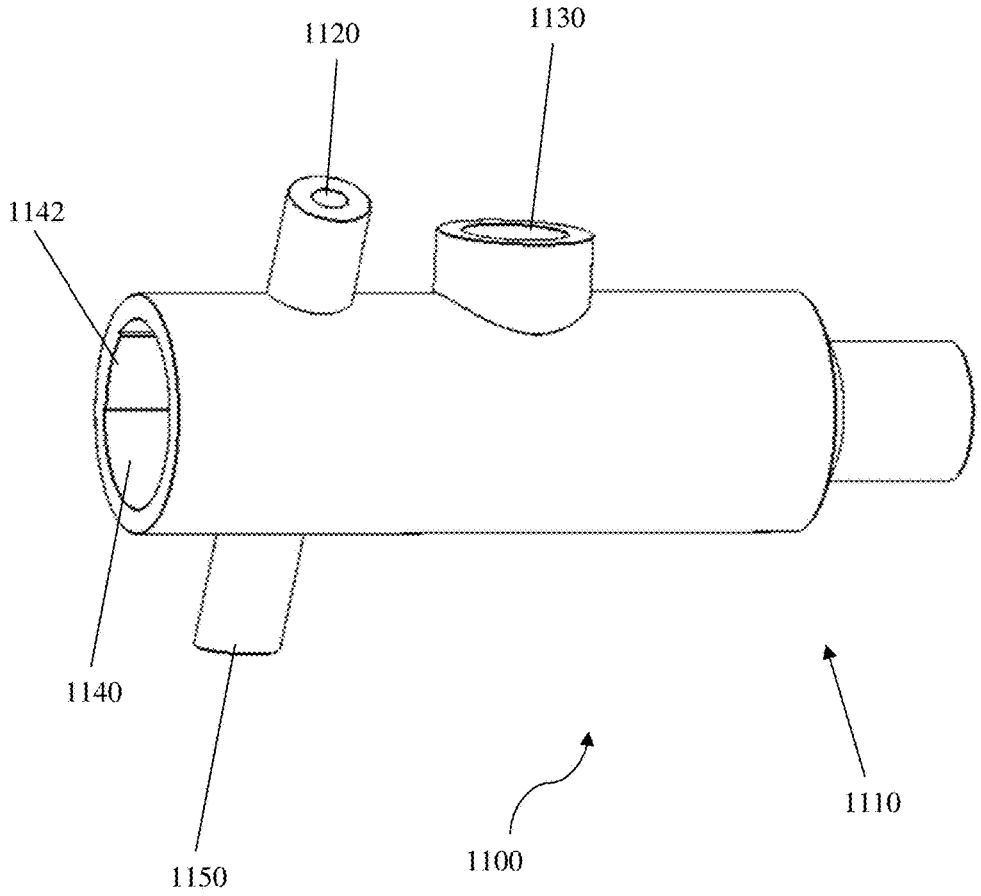
FIG. 11 is a side perspective view of an alternative embodiment of a tool block.

FIG. 11 depicts an alternative embodiment of tools of the inventive subject matter. Specifically, tool 1100 depicted in FIG. 11 is contemplated as a compact embodiment of tools in the inventive subject matter. It should be appreciated that such compact designs offer reductions in the cost of manufacturing material, as well as increased ease of use and portability for a user.

Similar to the embodiments discussed above, tool 1100 includes housing 1110 which includes applicator channel 1120, locking channel 1130, receiving channel 1140, and removal channel 1150. It is contemplated that firearm bolts be inserted into receiving channel 1140, preferably in a single orientation. Once inserted, a locking rod (as previously described) is inserted into locking channel 1130 to engage with the firearm bolt serving to both confirm that the bolt is in proper alignment for using the tool and to secure the bolt while the tool is in use. A removal rod (as previously described) may then be inserted into applicator channel 1120 and pressed to dislodge the extractor pin from the firearm bolt. Once the extractor pin is free from the firearm bolt, it will exit the tool through removal channel 1150, preferably into a receiving receptacle to prevent loss of the pin.

It is contemplated that most firearm bolts that have an extractor and an extractor pin will also have a spring that pushes the extractor away from the bolt. This tension can cause misalignment of the extractor pin holes of the extractor and the bolt, causing difficulty when reinserting the extractor pin into the firearm bolt assembly (e.g., by an inserting as previously described). To prevent misalignment of the extractor pin holes, tool 1100 includes a raised portion 1142 of receiving channel 1140. Raised portion 1142 acts to depress the extractor pin into the firearm bolt assembly, thereby maintaining proper alignment of the extractor pin holes of the extractor and the bolt, and easing insertion of the extractor pin. As depicted in FIG. 11, it should be appreciated that the projection of an axis passing through channels 1120 and 1150 over an axis passing through channel 1130 will have an angle θ as described in FIG. 9B, preferably 22.5°.

Figure 12A:
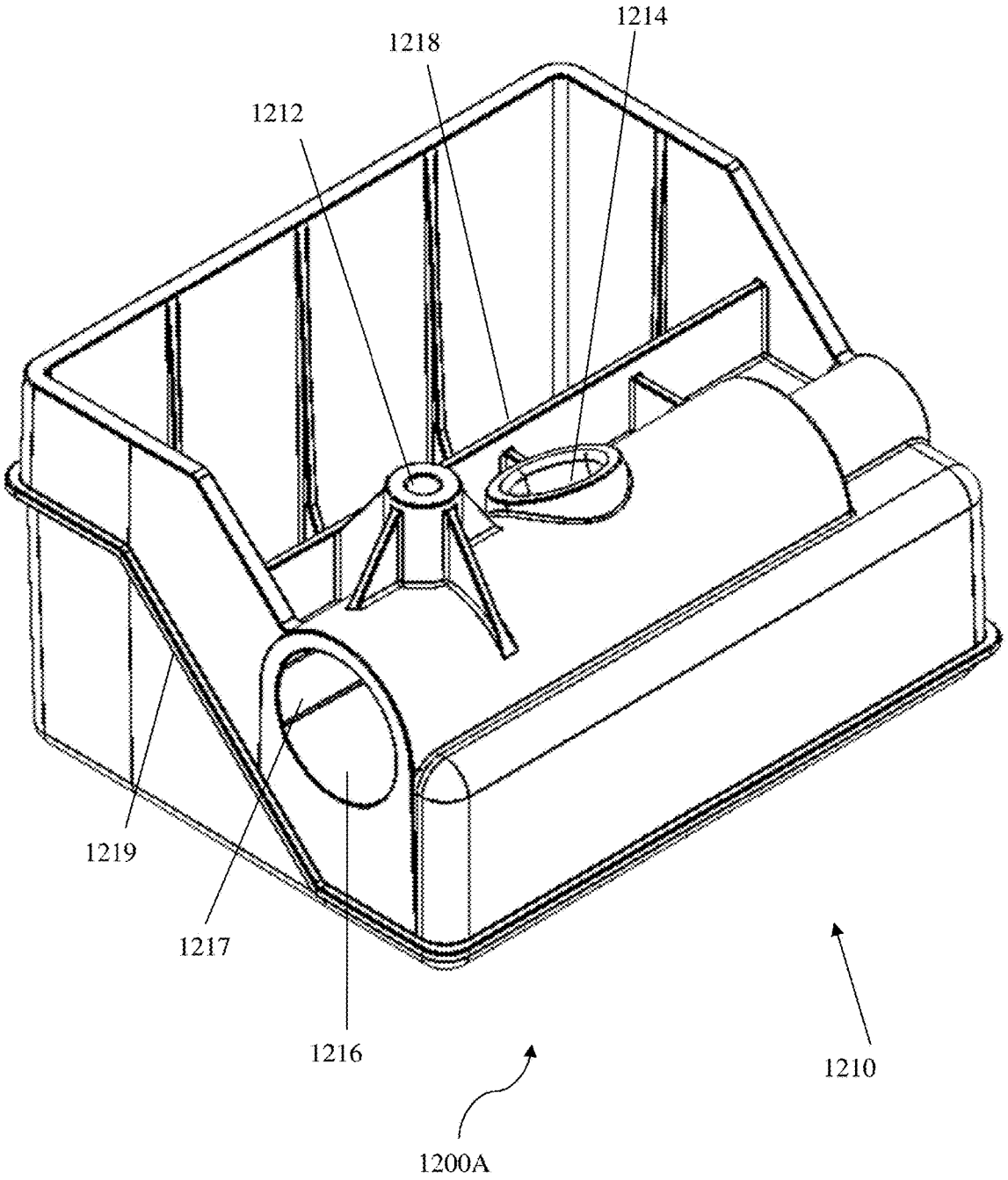
FIG. 12A is a front perspective view of a further alternative embodiment of a tool block portion of a tool assembly.
Figure 12B:
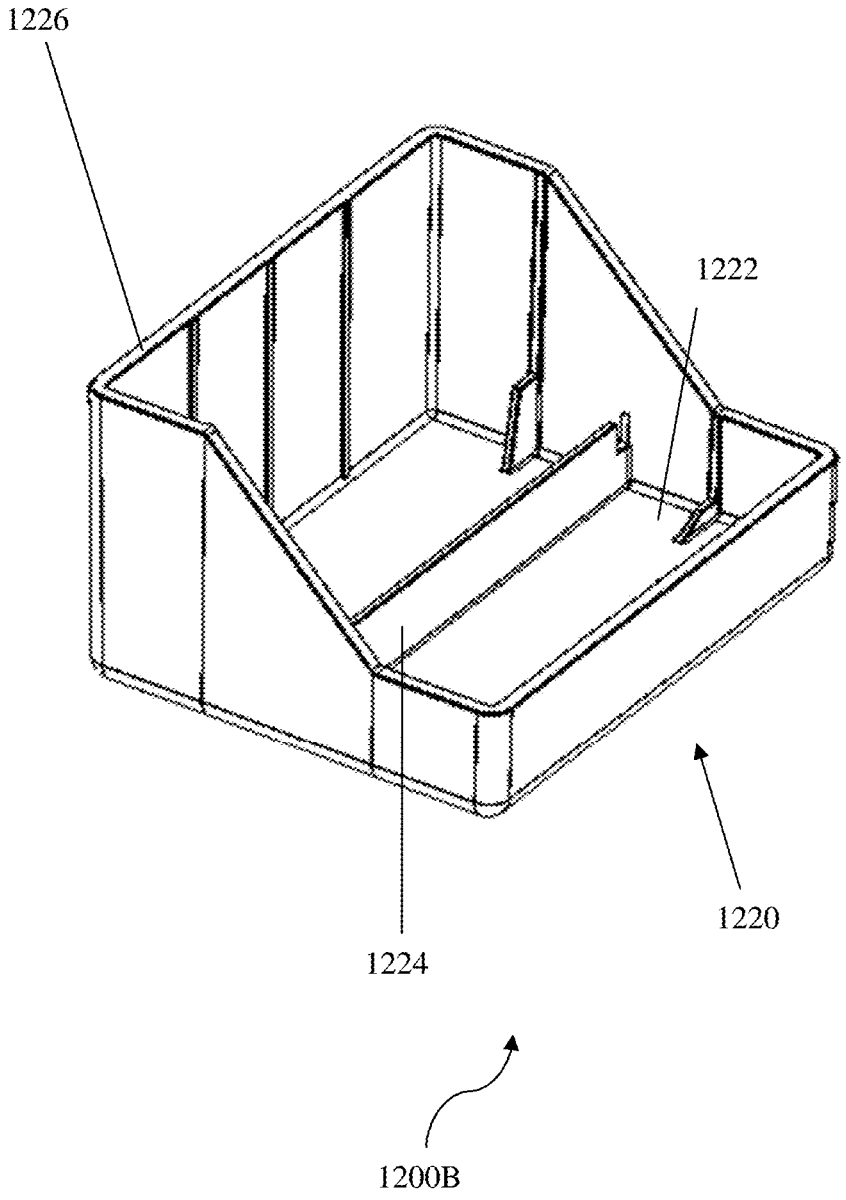
FIG. 12B is a front perspective view of a bottom lid portion of a tool assembly.
Figure 12C:
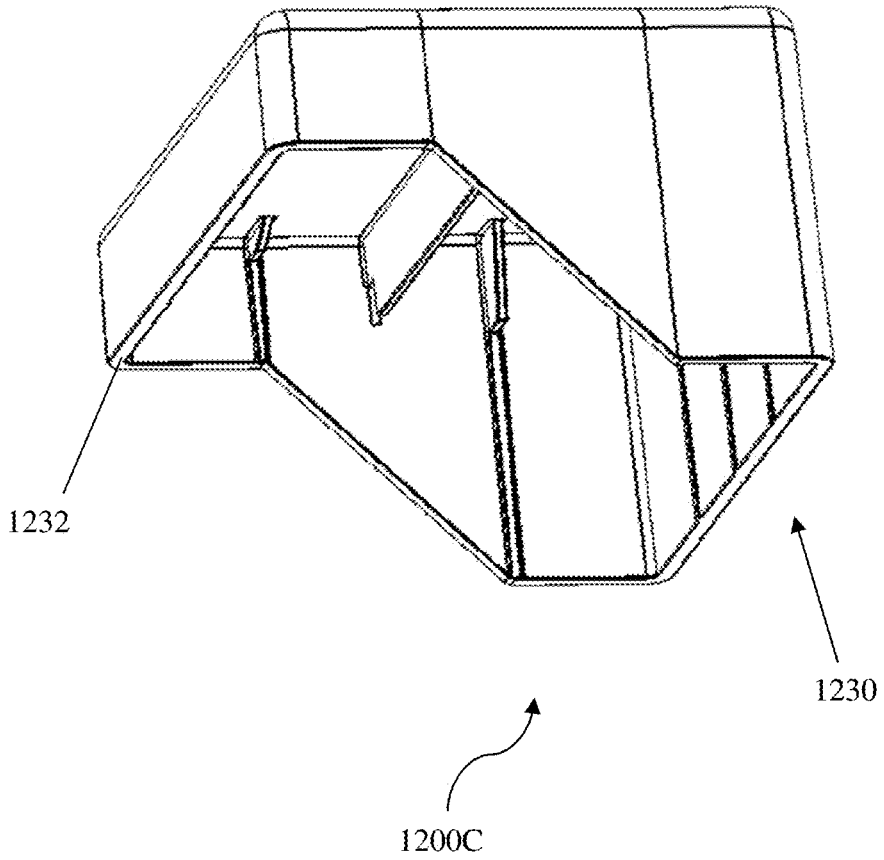
FIG. 12C is a bottom, left, front side perspective view of a top lid portion of a tool assembly.

FIGS. 12A-12C depict an alternative embodiment of tools in the inventive subject matter that include tool block 1200A, bottom lid 1200B, and top lid 1200C. Similar to previously discussed embodiments, tool block 1200A includes housing 1210 with applicator channel 1212, locking channel 1214, and receiving channel 1216. However, tool block 1200A further includes an accessory compartment 1218 as well as a lid resting rim 1219. Accessory compartment 1218 is designed to hold various tool components as depicted in the above embodiments (e.g., inserting rod 110, removal rod 120, locking rod 210, etc) as well as other firearm maintenance items (e.g., gun oil, wire brush, screw driver, swab, rag, etc.). As is further depicted below, lid resting rim 1219 acts as the coupling interface between tool block 1200A and bottom lid 1200B and top lid 1200C.

As depicted in FIG. 12A (and FIG. 13C), it should be appreciated that the projection of an axis passing through channel 1212 over an axis passing through channel 1218 will have an angle θ as described in FIG. 9B, preferably 22.5°.

As depicted in FIG. 12B, bottom lid 1200B provides further advantageous features such as extractor pin compartment 1222 and compartment wall 1224. When in a closed or operational confirmation (FIGS. 13B and 13C, respectively) housing 1220 of bottom lid 1200B couples to tool block 1200A along block mating rim 1226 and lid resting rim 1219. When in such confirmation, extractor pin compartment 1222 of bottom lid 1200B is disposed below applicator channel 1212 of tool block 1200A, allowing extractor pin compartment 1222 to catch the extractor pin of a firearm bolt assembly when the pin has been dislodged from the bolt during use of the tool. In some embodiments, it is contemplated that extractor pin compartment 1222 is fitted with a magnetic strip to attract and secure the extractor pin once it has been removed from the firearm bolt assembly.

As depicted in FIG. 12C, top lid 1200C has similar structure to bottom lid 1200B, including housing 1230 and block mating rim 1232. When in the tool assembly is in a closed confirmation (as in FIG. 13B), top lid 1200C is coupled to tool block 1200A along block mating rim 1232 and lid resting rim 1219. When in such confirmation, housing 1230 acts to enclose accessory compartment 1218 of tool block 1200A, securing tool components and other firearm maintenance items held within.

Figure 13A:
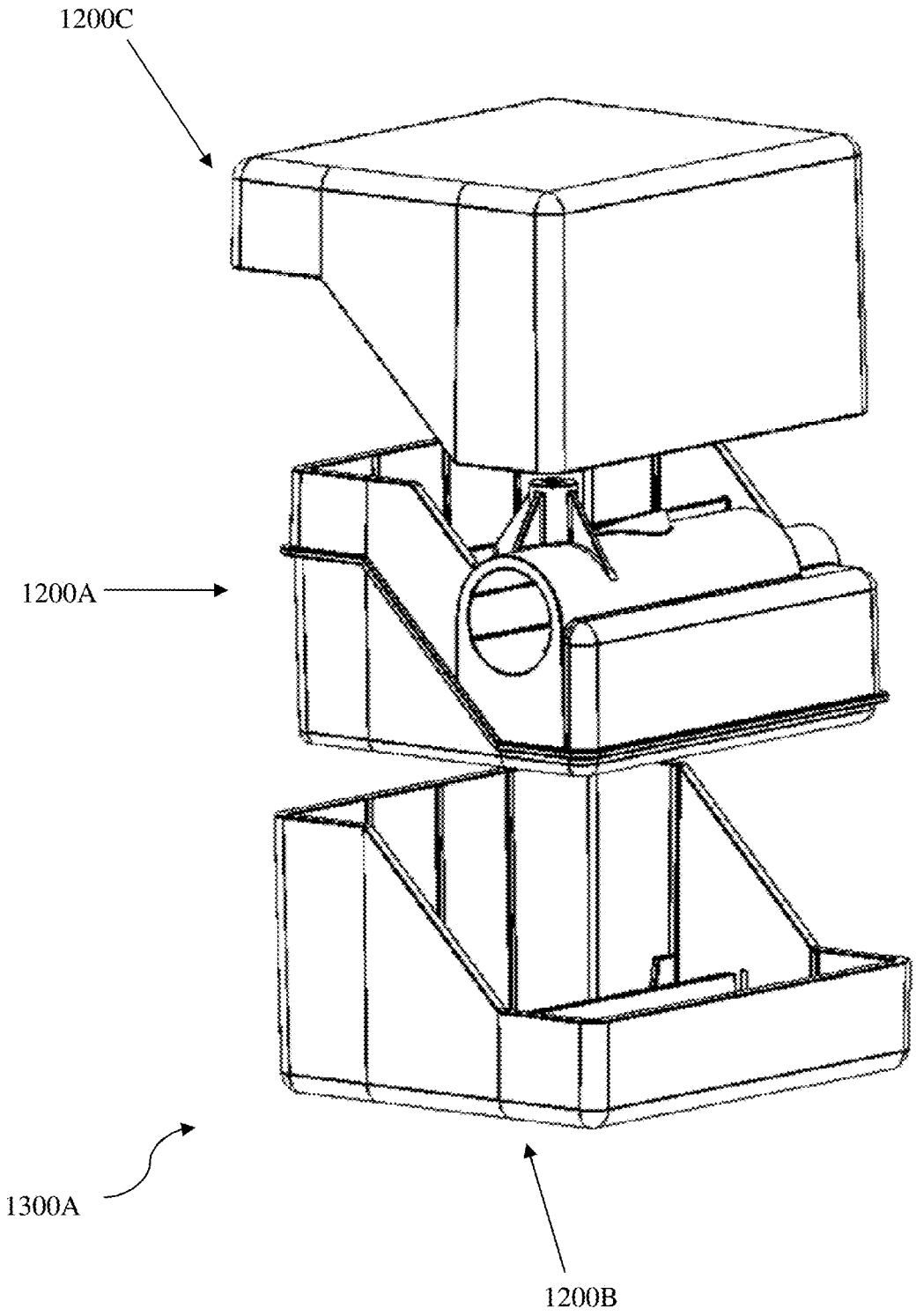
FIG. 13A is a front perspective view of an open configuration of a tool assembly.

FIG. 13A depicts open assembly 1300A of tool block 1200A, bottom lid 1200B, and top lid 1200C, and demonstrates the complimentary orientation of the various structures of 1200A, 1200B, and 1200C.

Figure 13B:
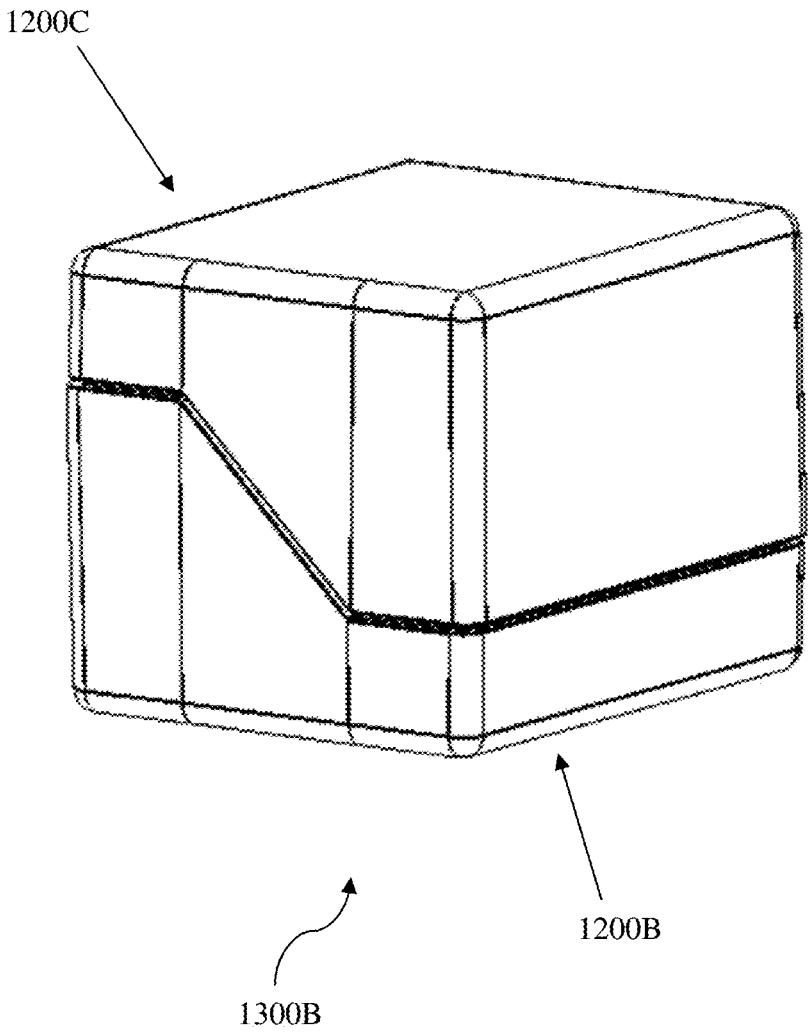
FIG. 13B is a front perspective view of a closed configuration of a tool assembly.

FIG. 13B depicts closed assembly 1300B of tool block 1200A, bottom lid 1200B, and top lid 1200C. As is depicted and previously described, in closed assembly 1300B both bottom lid 1200B and top lid 1200C couple with tool block 1200A along lid resting rim 1219, thus enclosing tool block 1200A within bottom lid 1200B and top lid 1200C. In such confirmation, any tool components or firearm maintenance items are secured within closed assembly 1300B. Any appropriate means of coupling tool block 1200A to bottom lid 1200B and top lid 1200C are contemplated, including mechanical means (e.g., clasps, hooks, detents, hooks and loops, clamps, clips, latches, pins, etc), chemical means (e.g., adhesive, etc), or electro-magnetic means (e.g., permanent magnet, electromagnet, etc). It is contemplated tools of the inventive subject matter having closed configurations (as depicted in FIG. 13B) advantageously prevent foreign material (e.g., grit, dirt, sand, grease, etc) from collecting in the various channels of the contemplated tools or otherwise damaging or obstructing use of the tools.

Figure 13C:
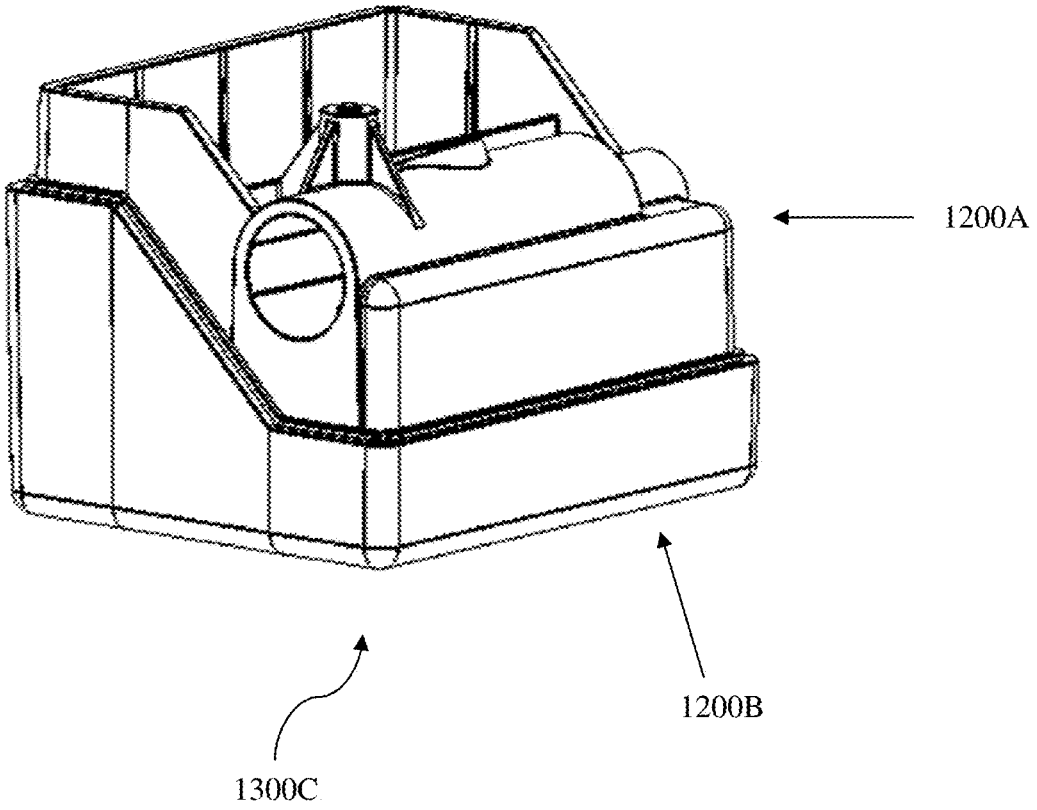
FIG. 13C is a front perspective view of an operational configuration of a tool assembly.

FIG. 13C depicts operating assembly 1300C. In this confirmation tool block 1200A is coupled to bottom lid 1200B along block mating rim 1226 and lid resting rim 1219. It is preferred that this confirmation is used when operating the tool, as extractor pin compartment 1222 of bottom lid 1200B is disposed below applicator channel 1212 of tool block 1200A, allowing extractor pin compartment 1222 to catch the extractor pin of a firearm bolt assembly when the pin has been dislodged from the bolt during use of the tool.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A tool for maintaining a firearm bolt with an extractor pin, wherein the bolt has a first hole for receiving the extractor pin and a second hole, the apparatus comprising:

a housing having a receiving channel and an applicator channel, wherein the receiving channel is sized and dimensioned to receive the bolt; and a removal rod having a size and a dimension for passing through at least a portion of the applicator channel and at least a portion of the first hole of the bolt when the bolt is in the receiving channel.

2. The apparatus of claim 1, wherein the receiving channel further comprises a groove having a size and a dimension configured to engage with a portion of the bolt to orient the bolt in the applicator channel.

3. The apparatus of claim 1, wherein the second hole of the bolt has a first and a second opening, wherein the apparatus further comprises a locking rod, and wherein a portion of the locking rod is sized and dimensioned to pass through the first opening, but not the second opening.

4. The apparatus of claim 1, wherein the receiving channel has a first end opposite to a second end, wherein the first end is configured to receive the bolt.

5. The apparatus of claim 4, wherein at least a portion of the receiving channel tapers from the first end toward the second end.

6. The apparatus of claim 3, wherein a first portion of the locking rod has a dimension narrower than a second portion of the locking rod.

7. The apparatus of claim 1, wherein a portion of the removal rod is sized and dimensioned to pass through the first hole of the bolt.

8. The apparatus of claim 1, wherein the housing further comprises a cavity having an opening defined by a rim along a surface of the housing, wherein the cavity has a size and a dimension configured to receive the locking rod and the removal rod, and wherein the rim is coupled to a lid.

9. The apparatus of claim 1, wherein the housing further comprises a receiving channel with a longitudinal axis perpendicular to a longitudinal axis of the locking channel.

10. The apparatus of claim 1, wherein the applicator channel intersects a portion of the receiving channel.

11. The apparatus of claim 1, wherein the housing further comprises a removal channel aligned along a longitudinal axis of the applicator channel, and having a dimension configured to receive the extractor pin.

12. A method for maintaining a firearm comprising a bolt and an extractor pin, wherein the bolt has a first hole for receiving the extractor pin and a second hole, by use of an apparatus comprising a housing having a receiving channel and an applicator channel, wherein the apparatus further comprises a removal rod, the method comprising the steps of:

inserting the bolt into the receiving channel of the housing; and removing the extractor pin from the bolt by pressing the removal rod into the applicator channel.

* * * * *